US008807512B2

(12) United States Patent
Watson et al.

(10) Patent No.: US 8,807,512 B2
(45) Date of Patent: Aug. 19, 2014

(54) UNDERGROUND TANK HOLD-DOWN SYSTEM

(71) Applicant: Watco Tanks, Inc., Floresville, TX (US)

(72) Inventors: David Watson, La Vernia, TX (US); Wallace Watson, Sutherland Springs, TX (US)

(73) Assignee: Watco Tanks, Inc., Floresville, TX (US)

( * ) Notice: Subject to any disclaimer, the term of this patent is extended or adjusted under 35 U.S.C. 154(b) by 0 days.

(21) Appl. No.: 13/687,432

(22) Filed: Nov. 28, 2012

(65) Prior Publication Data

US 2014/0145058 A1 May 29, 2014

(51) Int. Cl.

| | |
|---|---|
| ***A47B 97/00*** | (2006.01) |
| ***A47G 23/02*** | (2006.01) |
| ***F16B 2/08*** | (2006.01) |
| ***B65D 63/06*** | (2006.01) |

(52) U.S. Cl.

USPC ..... 248/505; 248/154; 248/225.21; 248/499; 24/21; 24/20 TT; 24/68 R; 24/68 CD; 24/265 H; 24/265 CD; 24/17 A; 24/19; 24/279; 292/256.65; 292/256.67

(58) Field of Classification Search

USPC ..... 248/505, 154, 74.1, 74.3, 506, 508, 248/225.21, 499; 405/172, 154; 24/21, 24/20 TT, 201 S, 68 R, 68 CD, 265 H, 24/265 CD, 17 A, 19, 279, 284, 20 R, 280; 292/256.65, 256.67

See application file for complete search history.

(56) References Cited

U.S. PATENT DOCUMENTS

| | | | | |
|---|---|---|---|---|
| 1,262,413 | A * | 4/1918 | Tyler | 24/282 |
| 5,655,265 | A * | 8/1997 | Schneider et al. | 24/21 |
| 5,848,776 | A * | 12/1998 | Craig et al. | 248/505 |
| 5,851,038 | A * | 12/1998 | Robinson et al. | 292/256.67 |
| 7,028,967 | B2 * | 4/2006 | Burwell et al. | 248/500 |

* cited by examiner

*Primary Examiner* — Terrell McKinnon
*Assistant Examiner* — Christopher Garft
(74) *Attorney, Agent, or Firm* — Jackson Walker, LLP

(57) ABSTRACT

An underground fluid storage tank hold-down system for holding down an underground cylindrical fluid storage tank in a hole that has been excavated, the underground tank hold-down system comprising a multiplicity of paired hold-down straps having a first end and a second end. A multiplicity of paired deadmen anchors are adapted to be placed to either side of the tank when the tank is in the hole. The deadmen anchors each have anchor upstanding loops. A tank hold-down assembly is provided comprising a take-up coupler assembly having a pair of arched sections, having hooks thereon, including a first arched section and a second arched section and a threaded engagement assembly. The threaded engagement assembly includes a threaded member and a receiving member adapted to receive part of the threaded member. The straps engage the hooks and the anchor upstanding loops.

9 Claims, 14 Drawing Sheets

Take-Up Coupler Assembly
Front View

Tank Hold-Down Assembly
Perspective View

Tank Hold-Down Assembly Engaged with Tank
Perspective View

Take-Up Coupler Assembly
Top View

Take-Up Coupler Assembly
Front View

Take-Up Coupler Assembly
Side View

Item 12
Take-up Coupler Assembly
Front View

Take-Up Coupler Assembly
DETAIL A
Perspective View

Take-Up Coupler Assembly
DETAIL A
Front View

Take-Up Coupler Assembly
DETAIL C
Perspective View

Item 12
Take-up Coupler Assembly
Front View

Take-Up Coupler Assembly
DETAIL B
Perspective View

Take-Up Coupler Assembly
DETAIL B
Front View

First Arched Section
Top View

First Arched Section
Front View

First Arched Section
Perspective View

Second Arched Section
Top View

Second Arched Section
Front View

Second Arched Section
Perspective View

Tank Hold-Down Assembly
Strap & Hook
Front View

Tank Hold-Down Assembly
Strap & Hook Engaged
Perspective VIew

Tank Hold-Down Assembly
Strap & Hook Engaged
Front View

Tank Hold-Down Assembly
with Slab Option
Perspective View

UNDERGROUND TANK HOLD-DOWN SYSTEM

FIELD OF THE INVENTION

Hold-down systems, more specifically, a hold-down system for underground fluid storage tanks.

BACKGROUND OF THE INVENTION

This invention relates to the installation of underground storage tanks, more specifically, horizontal, cylindrical fluid storage tanks in an area that may be subject to a high water table. With a high water table, the underground tanks may become buoyant when the water table rises up past the lower walls thereof and, thus, there is a need for a hold-down system. Further, a device and system is needed that eliminates the "man downhole" situation, where a man must enter an excavated hole, to the floor thereof, to engage a hold-down strap to a deadman or other similar devices, such as a slab or other anchor-type device (hereinafter called deadmen).

SUMMARY OF THE INVENTION

An underground fluid storage tank hold-down system for holding down an underground cylindrical fluid storage tank in a hole that has been excavated, the underground tank hold-down system comprising a multiplicity of paired hold-down straps having a first end and a second end; a multiplicity of paired deadmen anchors adapted to be placed to either side of the tank when the tank is in the hole, the deadmen anchors each with anchor upstanding loops; and a tank hold-down assembly comprising a take-up coupler assembly having a pair of arched sections, including a first arched section and a second arched section and a threaded engagement assembly, the threaded engagement assembly including a threaded member and a receiving member adapted to receive part of the threaded member, wherein the paired straps are adapted to engage the arched sections at a first end and the paired deadmen anchor eyes or loops at a second end; and wherein the first and second arched sections each comprise a multiplicity of strap engaging hooks and means to engage the threaded member to the first arched section and the receiving member to the second arched section such that rotation of the threaded member when it is engaged with the receiving member brings the two sections closer to one another and snugs the straps to the walls of the underground tank.

A method for securing an underground storage tank in an excavated area, comprising the steps of providing on the bottom of an excavation an anchoring assembly comprising a multiple of paired upstanding anchor spaced apart loop sections; providing a multiplicity of paired hold-down straps, each having a first end and a second end, a length, and a width; a multiplicity of paired deadmen anchors adapted to be placed to either side of the tank when the tank is in the hole, the deadmen anchors each with anchor upstanding loops; a tank hold-down assembly comprising a take-up coupler assembly having a pair of arched sections, including a first arched section and a second arched section and a threaded engagement assembly, the threaded engagement assembly including a threaded member and a receiving member adapted to receive part of the threaded member; wherein the paired straps are adapted to engage the arched sections at a first end of the straps and the paired deadmen anchors at a second end of the straps; and wherein the first and second arched sections each comprise a multiplicity of strap engaging hooks and walls to engage the threaded member to the first arched section and the receiving member to the second arched section such that rotation of the threaded member when it is engaged with the receiving member brings the two sections closer to one another and snugs the straps down to the walls of the underground tank; attaching each strap to the multiple strap pairs to the anchor upstanding loops and the take-up coupler assembly having the threaded member engaging the arched section; and rotating the threaded member until the straps are snug.

DETAILED DESCRIPTION OF THE PREFERRED EMBODIMENTS

Applicant discloses a tank hold-down assembly 10 for use with the tank. The tank may be an underground storage tank, such as a 10 foot by 21 foot cylindrical tank (12 k gallons), a 10 foot by 34 foot cylindrical tank (20 k gallons), a 10 foot by 77 foot (45 k gallons) cylindrical tank or any other size cylindrical tank for laying into an excavated hole with a long axis horizontal. These tanks are sometimes used at filling stations to hold gasoline (or other fluids) for supply of the pumps of the station. They are laid in excavated holes, horizontally disposed, and often into a bed of pea gravel (or other suitable material) with deadman anchors paired on either side of the tank. Such prior art systems may be found in U.S. Pat. No. 7,028,967, which patent is incorporated herein by reference.

Figure 2:
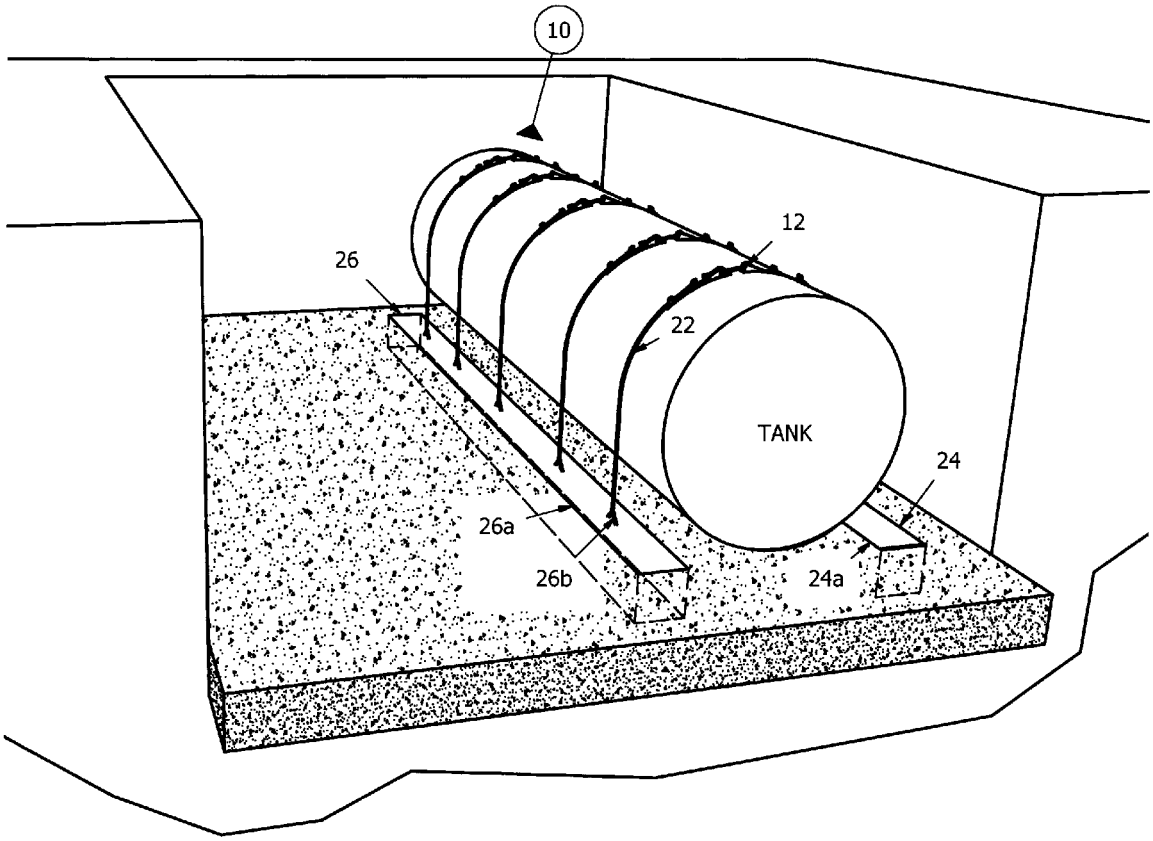
FIG. 2 is a perspective view of tank hold-down assembly 10 engaged with tank.

Typically, as seen in FIG. 2, the deadman (or anchor) assemblies 24/26 are placed in the pits with cranes on either side of the tank space and covered with pea gravel except for the exposed looped sections 24*b*/26*b*. The exposed looped sections 24*b*/26*b* are set in the concrete deadman to provide means for engaging straps to the deadman, which straps may then be laid up alongside the tank and partially across the top as further set forth below.

Figure 1:
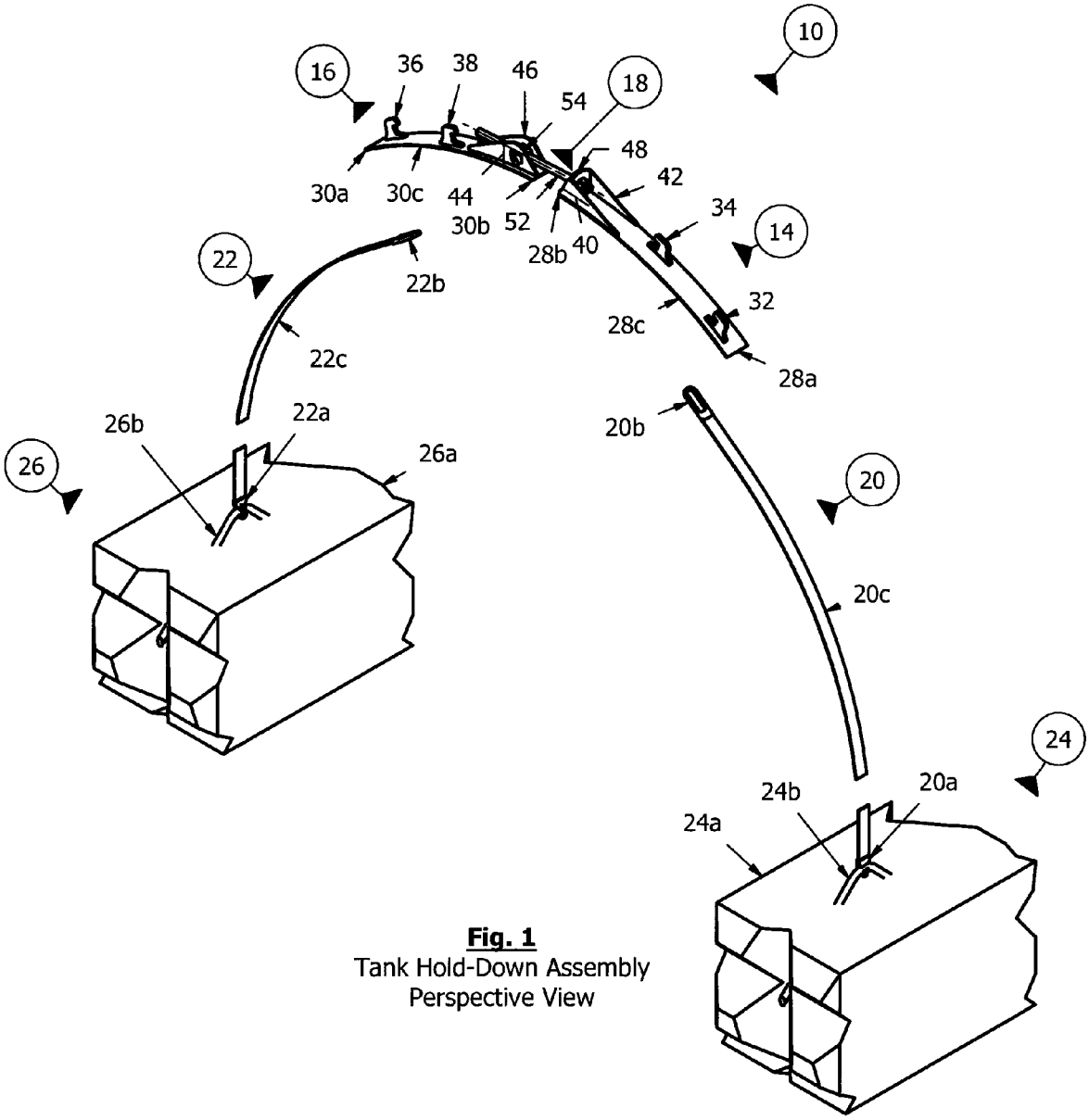
FIG. 1 is a perspective view of tank hold-down assembly 10.

Applicant's underground tank hold-down assembly 10 includes a take-up coupler assembly 12 having a pair of arched sections, including a first arched section 14 and a second arched section 16. The two arched sections are engaged with a threaded engagement assembly 18. Straps 20/22 laying down each side of the container as set forth in FIGS. 1 and 2 engage the deadman assemblies such that, as the threaded engagement assembly is operated as set forth here in the two arched sections, will move closer together and will tighten up the straps to snugly hold the tank pressed into the pea gravel bed by the weight of the deadman. Thus, the tank, coupled snugly to the deadman, will resist the forces of buoyancy should the water table rise.

Turning now to the details of Applicant's underground tank hold-down assembly 10, it is seen that arched sections 14/16 typically comprise rectangular, curved bases 28/30 adapted to sit flush against the exterior walls of the tank (usually with a bumper pad or resilient member between them and the tank). The arched section bases usually have a radius of curvature substantially equal to that of the tank. If the tank exterior is ribbed, the assembly may be placed in the ribs or on the non-rib surface. Bases may be made up of mild 10 gauge steel. Bases 28/30 typically have a first end 28*a*/30*a*, a second end 28*b*/30*b*, and a body 28*c*/30*c* therebetween.

A multiplicity, here, at least a pair of hooks first and second hooks 32/34, may be found on curved base 28 and a pair of first and second hooks 36/38 on curved base 30. The hooks are adapted to receive second ends 20*b*/22*b* of straps 20/22. First end 20*a*/22*a* of straps 20/22 are adapted to include curved or hook members for engaging loops 24*b*/26*b* embedded in and extending above deadmen bodies 24*a*/26*a* (see FIG. 1).

Figure 3:
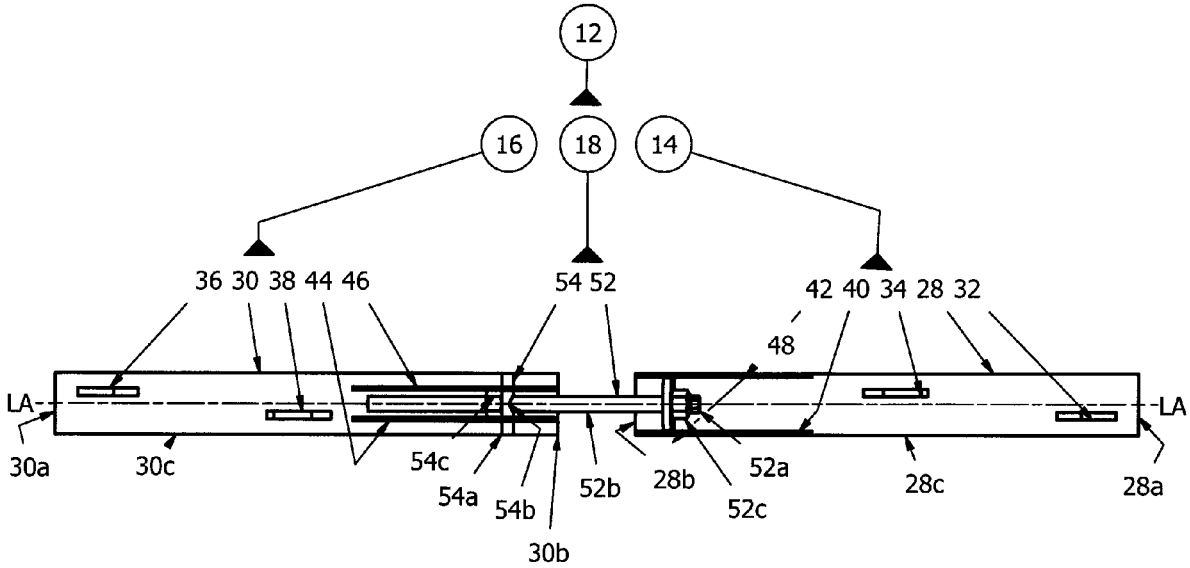
FIG. 3 is a top view of take-up coupler assembly 12.

First and second arched section hooks 32/34/36/38 are typically spaced apart longitudinally as best seen in FIG. 3, with respect to one another and offset to either side of a longitudinal axis LA of the take-up coupler assembly 12, such that in the case where the straps, being of fixed (i.e., non-adjustable) length, are too long to engage hooks 32/36, they may be placed in hooks 34/38 of the offset, so that the strap bodies 20*c*/22*c* lay adjacent rather than on top of hooks 32/36. Last, with respect to FIG. 3, typically the "top hooks" 34/38 are on opposite sides of LA, as are the "bottom" hooks 32/36.

Figure 4:
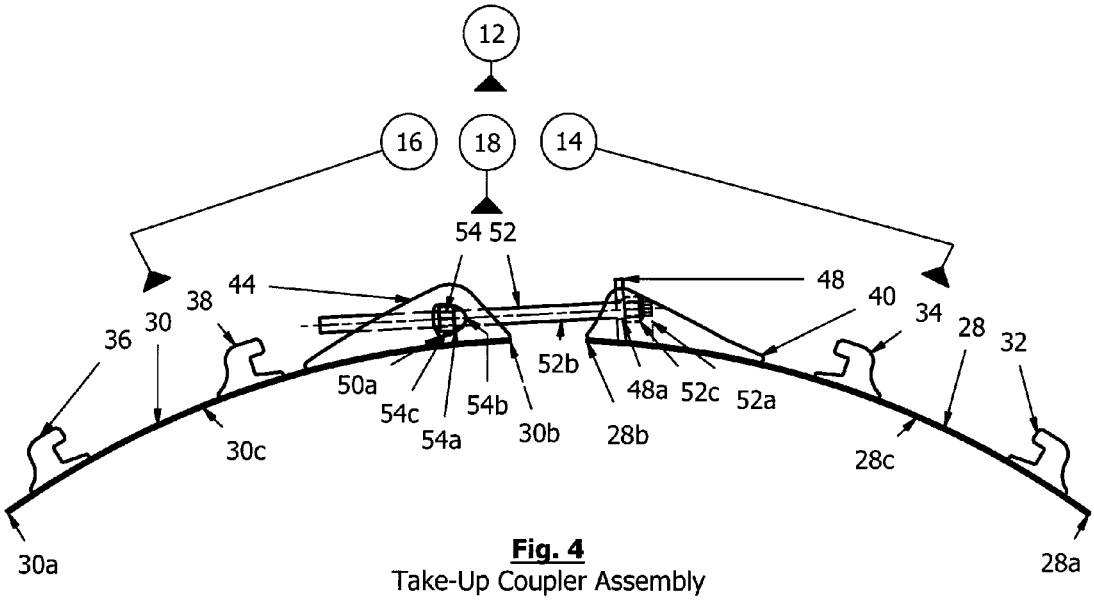
FIG. 4 is a front view of take-up coupler assembly 12.
Figure 5:
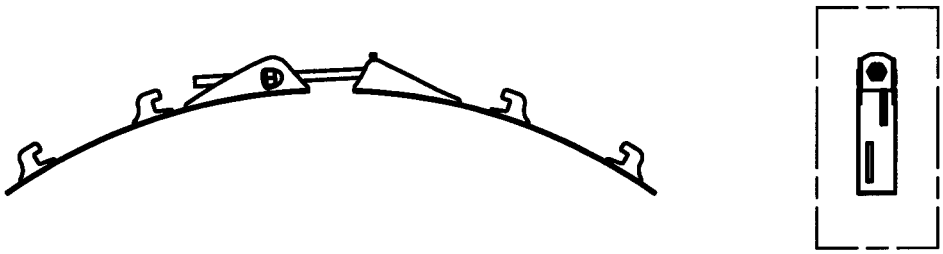
FIG. 5 is a side view of take-up coupler assembly 12.
Figure 5:
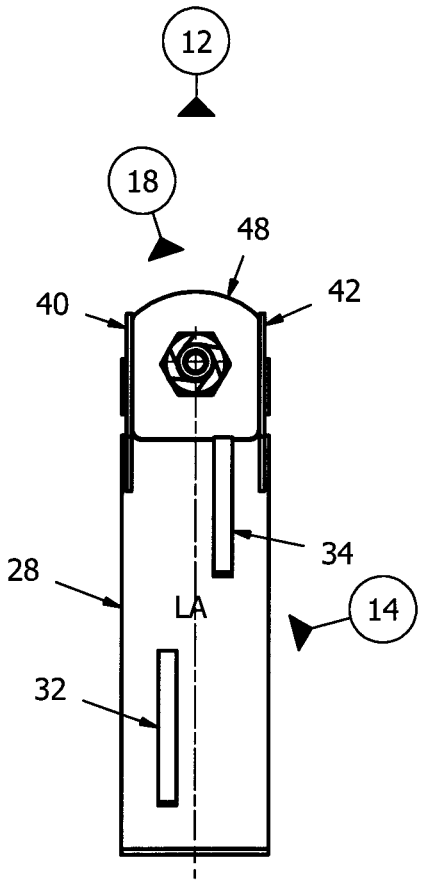
Figure 6B:
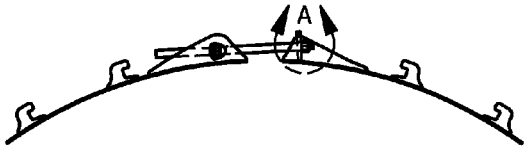
FIG. 6B is a detail perspective view of take-up coupler assembly 12, Detail A.
Figure 6B:
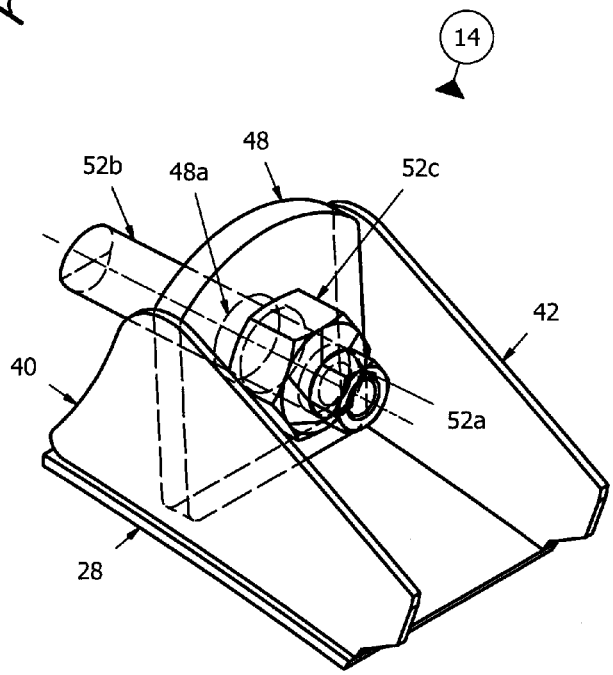
Figure 6A:
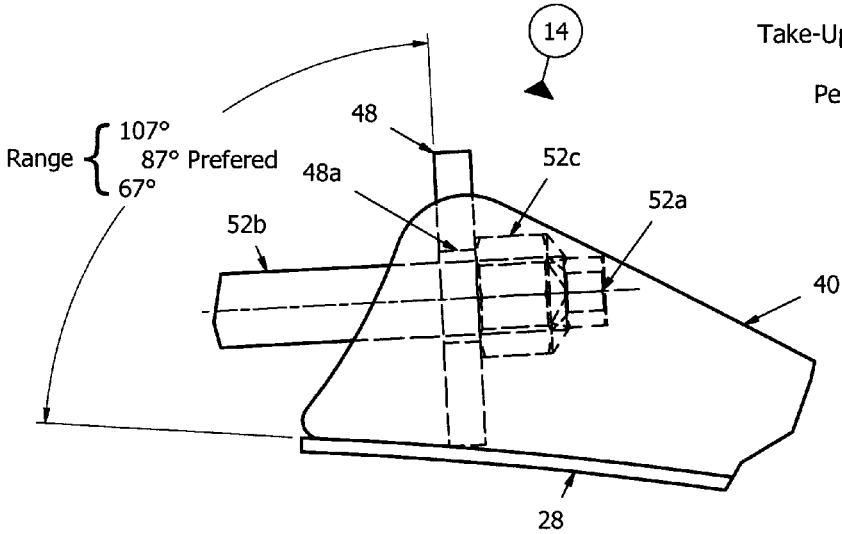
FIG. 6A is a detail front view of take-up coupler assembly 12, Detail A.
Figure 8B:
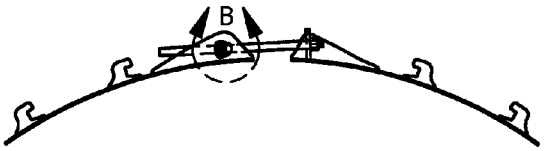
FIG. 8B is a detail perspective view of take-up coupler assembly 12, Detail B.
Figure 8B:
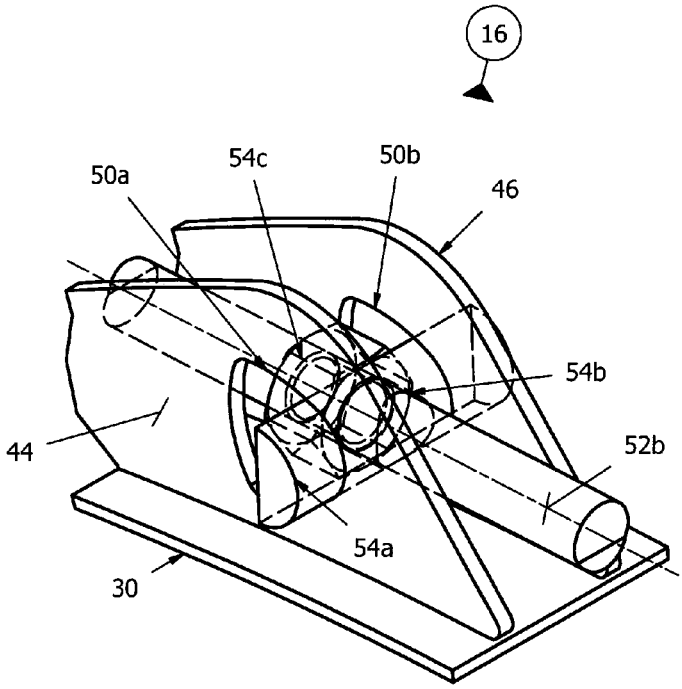
Figure 8A:
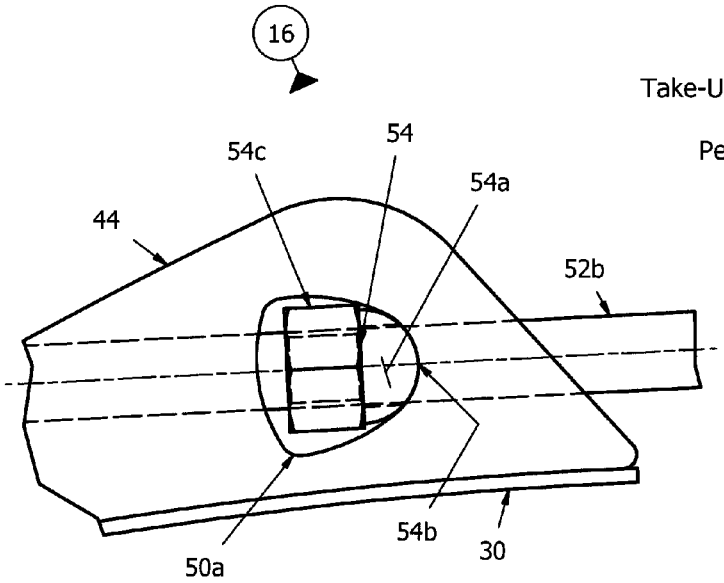
FIG. 8A is a detail front view of take-up coupler assembly 12, Detail B.
Figure 9:
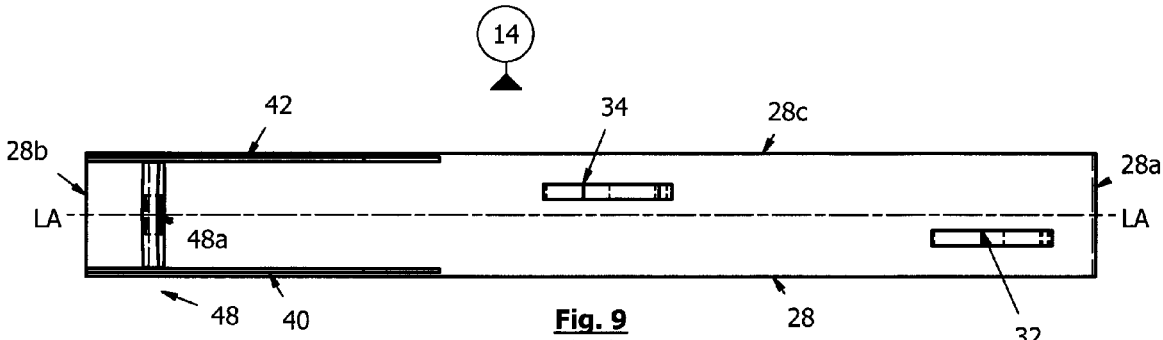
FIG. 9 is a top view of first arched section 14.
Figure 10:
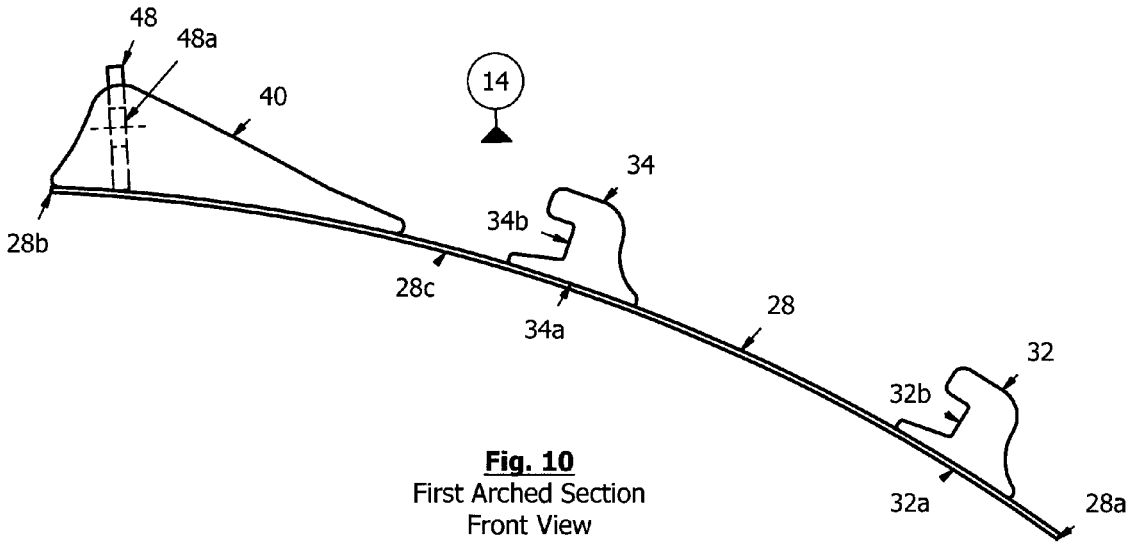
FIG. 10 is a front view of first arched section 14.
Figure 11:
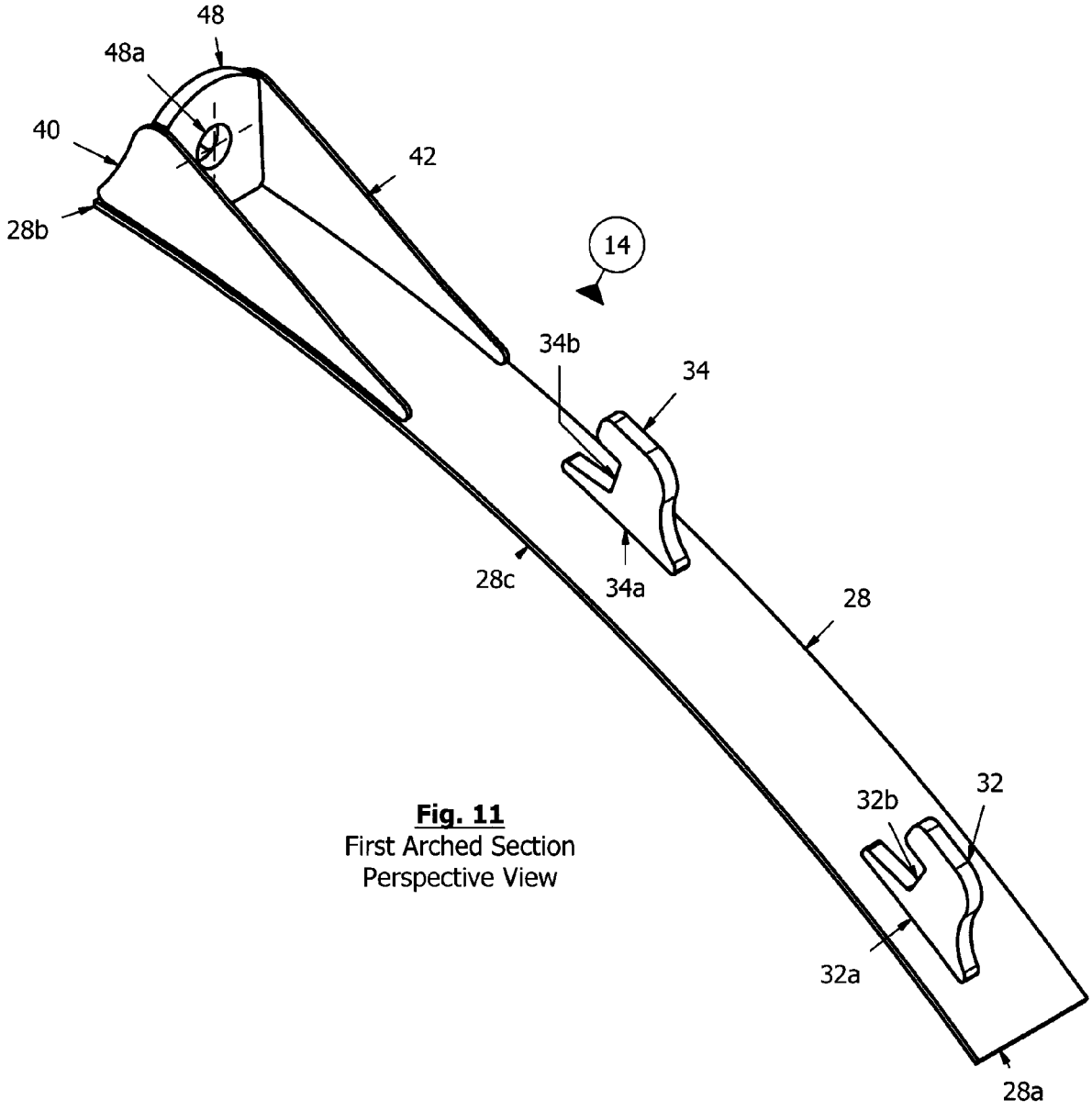
FIG. 11 is a perspective view of first arched section 14.
Figure 12:
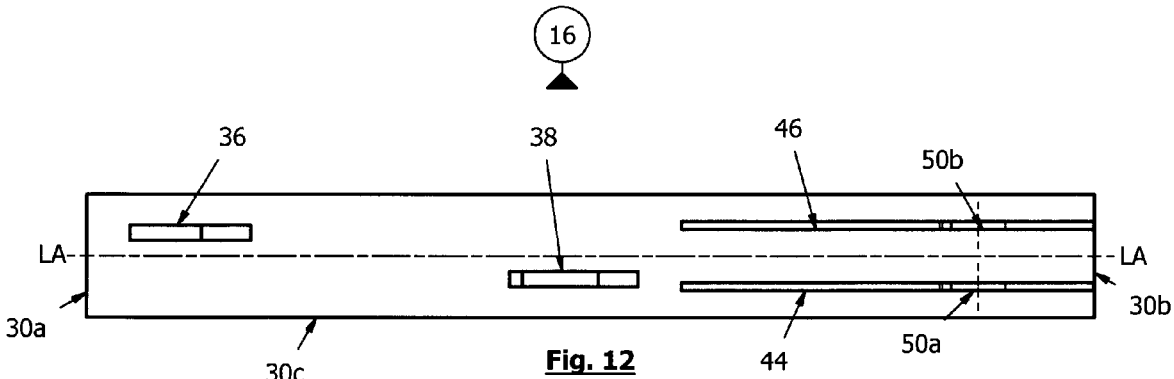
FIG. 12 is a top view of second arched section 16.
Figure 13:
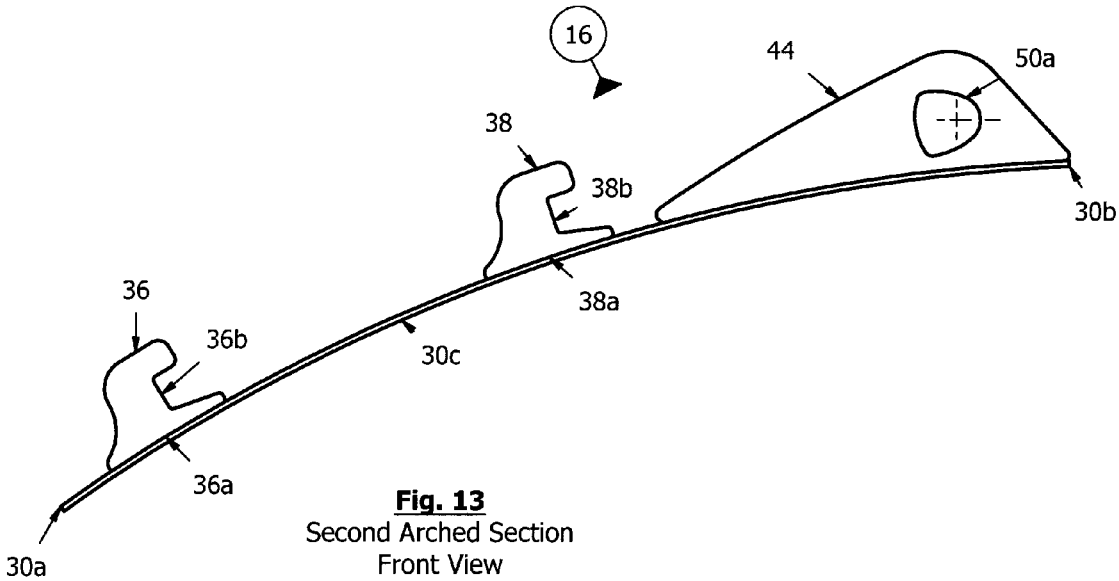
FIG. 13 is a front view of second arched section 16.
Figure 14:
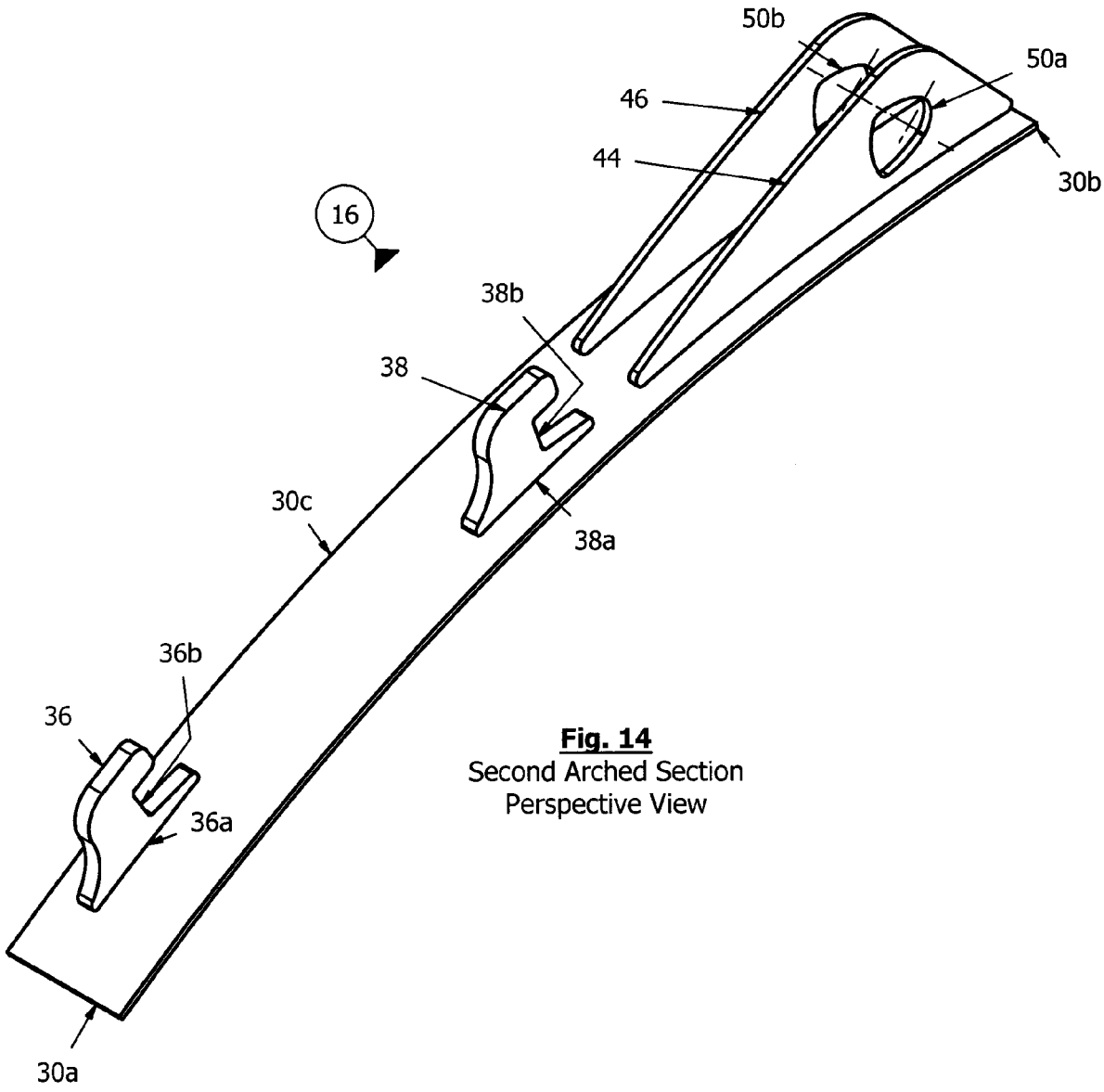
FIG. 14 is a perspective view of second arched section 16.

Turning to FIGS. 3-4, it is seen that raised shoulders 40/42 are provided on curved base 28 adjacent second end 28*b* and raised shoulders 44/46 are adjacent second end 30*b* of curved base 30 as seen in FIGS. 3 and 4. Between raised shoulders 40/42 is a transverse plate 48 with a hole 48*a* therein. Turning to FIGS. 6A and 6B, it is seen that transverse plate 48 may make an angle in the range of about 67° to 107° (about 87° preferred) with the curved base 28. Turning to FIGS. 8A and 8B, raised shoulders 44/46 on second curved base 30 have a pair of opposing cutout windows 50*a*/50*b* for use as set forth in more detail below.

Figure 7:
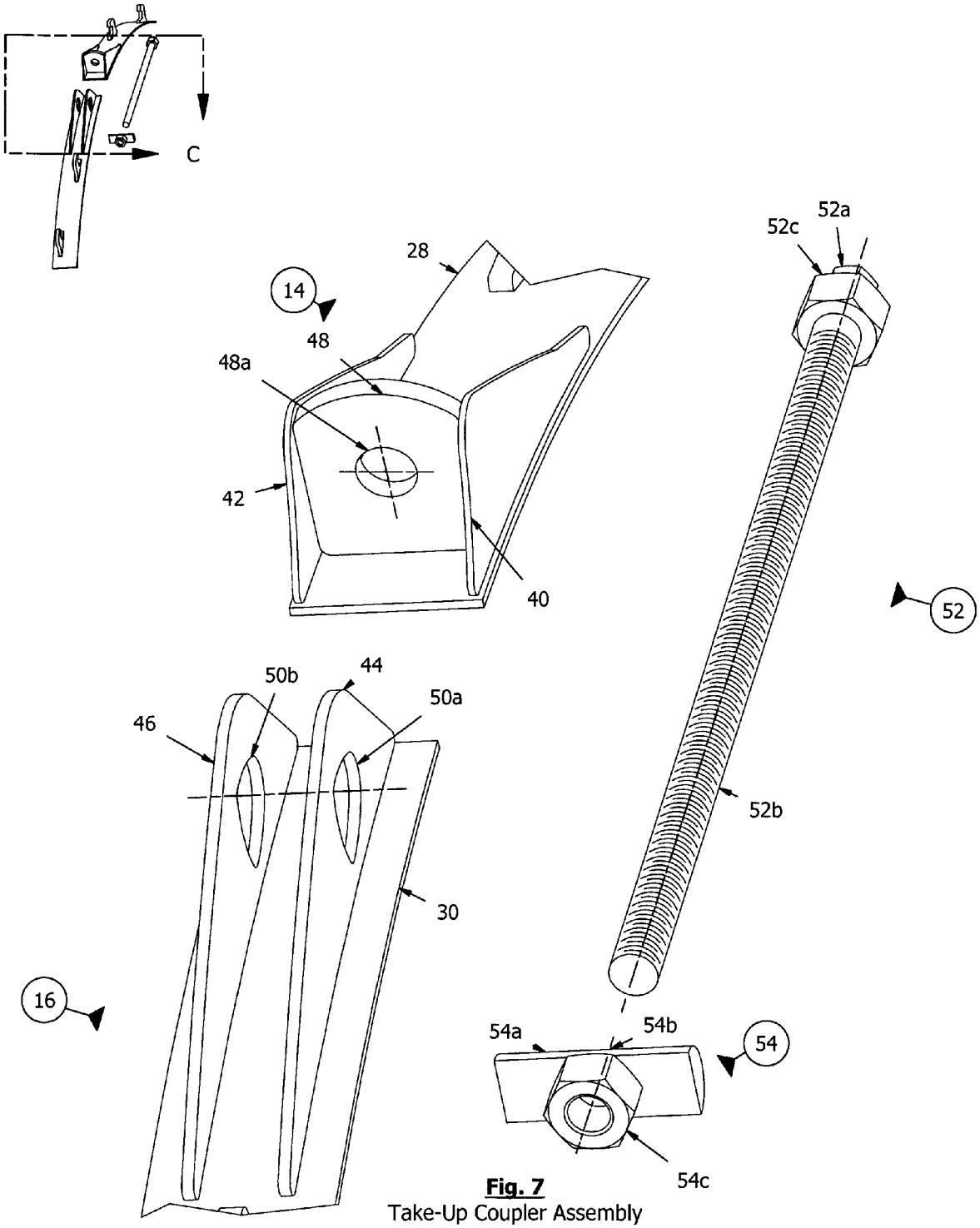
FIG. 7 is a detail perspective view of take-up coupler assembly 12, Detail C.

Threaded engagement assembly 18 includes an elongated rotating member 52 typically including a threaded body 52*b* with a fixed, tool engaging head 52*a*, such as a nut welded to one end thereof. Threaded engagement assembly 18 typically includes a threaded receiver 54 adapted to threadably engage threaded body 52*b*. Threaded receiver 54 may include a transverse member 54*a* with a hole 54*b* therethrough, which hole is designed to accommodate the diameter of threaded body 52*b*, and which transverse member 54*a* is sufficient to engage and span between windows 50*a*/50*b* as seen, for example, in FIG. 8B, while engaging the walls of the windows. As seen in FIG. 7, a threaded nut 54*c* is welded to the backside of transverse member 54*a* at hole 54*b* to receive threaded rotating member 52. Windows 50*a*/50*b* are designed to transversely receive threaded receiver 54 therethrough, such that with threaded body 52*b* extending through hole 48*a* and engaging nut 54*c* of threaded receiver 54, rotation of fixed tool engaging head 52*a*, with a tool, for example, will bring arched sections 14/16 towards one another. With straps 20/22 engaged with the deadman and the first and second section, rotating elongated rotating member 52 and drawing the two sections together, will tighten the straps up until the tank is held down tight and fast to the anchor points.

FIGS. 7, 8A and 8B illustrate that a threaded receiver assembly 54 may include a transverse member 54*a* with a hole 54*b* therethrough and a threaded member or nut 54*c*. Threaded body 52*b* is dimensioned for receipt through a hole 54*b* into threaded member 54*c*, such that rotation of threaded rotating member 52 in a first direction will bring threaded receiver assembly 54 closer to fixed tool engagement head 52*a*. Fixed engaging head 52*c* may be a nut welded to threaded body 52*b*. Cutout windows 50*a*/50*b* may be any suitable shape, but typically have a curved leading edge to match the curved leading edge of transverse member 54*a*.

Hold-down straps may include those available as part No. HDS128.38-C3D3-0CL0 from Pultrusion Technique Inc. of St. Bruno, Canada. These straps typically include a fiberglass reinforced resin body with hot dipped galvanized hooks at one end (each with a mouth open wide enough to engage an upstanding anchor loop) and D-rings (or other closed loops) at the other end for engaging the anchors and the first and second arched sections, respectively. They may be designed to withstand a tensile load of 25,000 lbs. each. See www.pultrusiontech.com. These straps may be come in about 100", 110" or 128⅜" lengths. They are non-compressible, fixed length, and bendable to conform to the curve of the tank outer surface.

Typically, when paired straps are used, they may be hooked into the lower hooks 32/36 and, when threaded rotating member 52, typically about 24 inches long threadably engages the plate 48 and threaded receiver 54, the body of the threaded member will lay close to the tank, but not touch it. Indeed, one of the advantages of Applicant's system over the prior art is that the threaded member, which couples the sections, lays low, close to the outer surface of the tank when the sections are engaged so as to reduce the bending moment. A typical range between the underside of the elongated rotating member when the assembly is cinched down is in the range of about ¾ inch to 1⅝ inch, preferred about 1³⁄₁₆". This low profile is, in part, achieved by bringing the plate and windows within the range of about 4 to 30 to one another when the strap is cinched down. The low profile is also achieved by placement of the center of hole 48*a* on plate 48 preferably at about 2¼ inches above the underside of the curved base 28 or in the range of about 1¾ to 2¾ inches, and the center of windows 50*a*/50*b* preferably at about 1¾ inches above the underside of curved base 30 or in the range of about 1¼ to 2¼ inches.

FIGS. 9, 10, 11, 12, 13, and 14 illustrate front, top, and perspective views of the first arched section 14 and second arched section 16. They illustrate the manner in which hooks 32/34 may be spaced apart longitudinally and offset from a longitudinal axis LA of the arched sections. Moreover, with respect to FIG. 10, they illustrate the manner in which the mouths 32*b*/34*b*/36*b*/38*b* of the hooks 32/34/36/38 are defined, in part, by a ramp-shaped leading edge of the bases 32*a*/34*a*/36*a*/38*a*, such that, when the hooks engage the strap second ends, the second strap ends are held off the curved base. While two hooks are preferred for each arched section, one (centered on the longitudinal axis) may be used or more than two may be used (spaced apart and offset).

Figure 15:
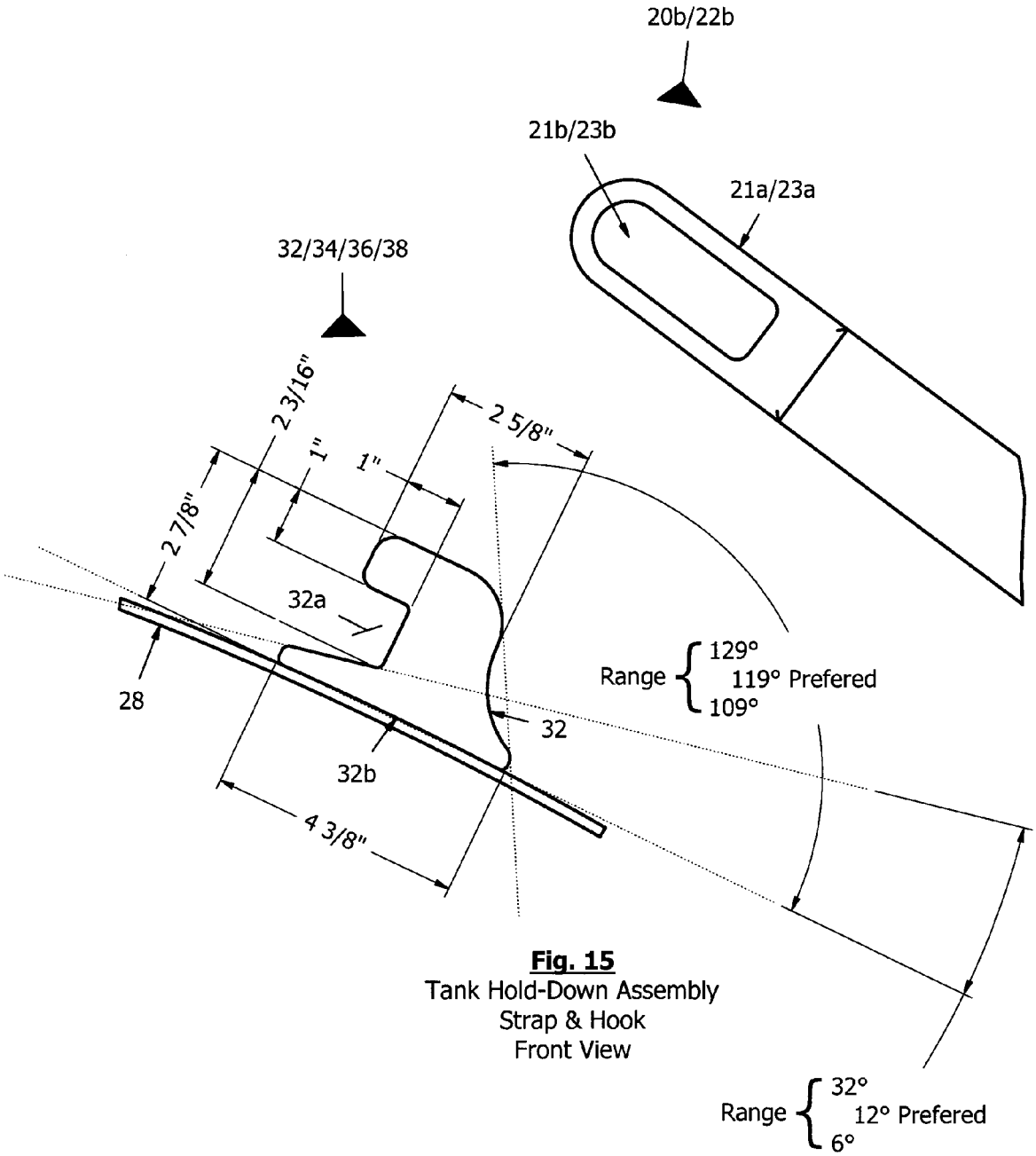
FIG. 15 is a perspective view of tank hold-down assembly 10 with strap and hook.

FIG. 15 illustrates that the leading edge ramp portion of a base 32 (all hooks are similarly constructed) may make an angle of about 6° to 32° with about 12° preferred with respect to the base underside. The base may be about 4⅜ inch long and the mouth may be about 1 3/16 inch wide. The angle between the trailing edge portion of the hook may be between 109° and about 129°, preferred about 119° with respect to the base underside. Hook height and mouth dimensions are also provided.

Figure 16:
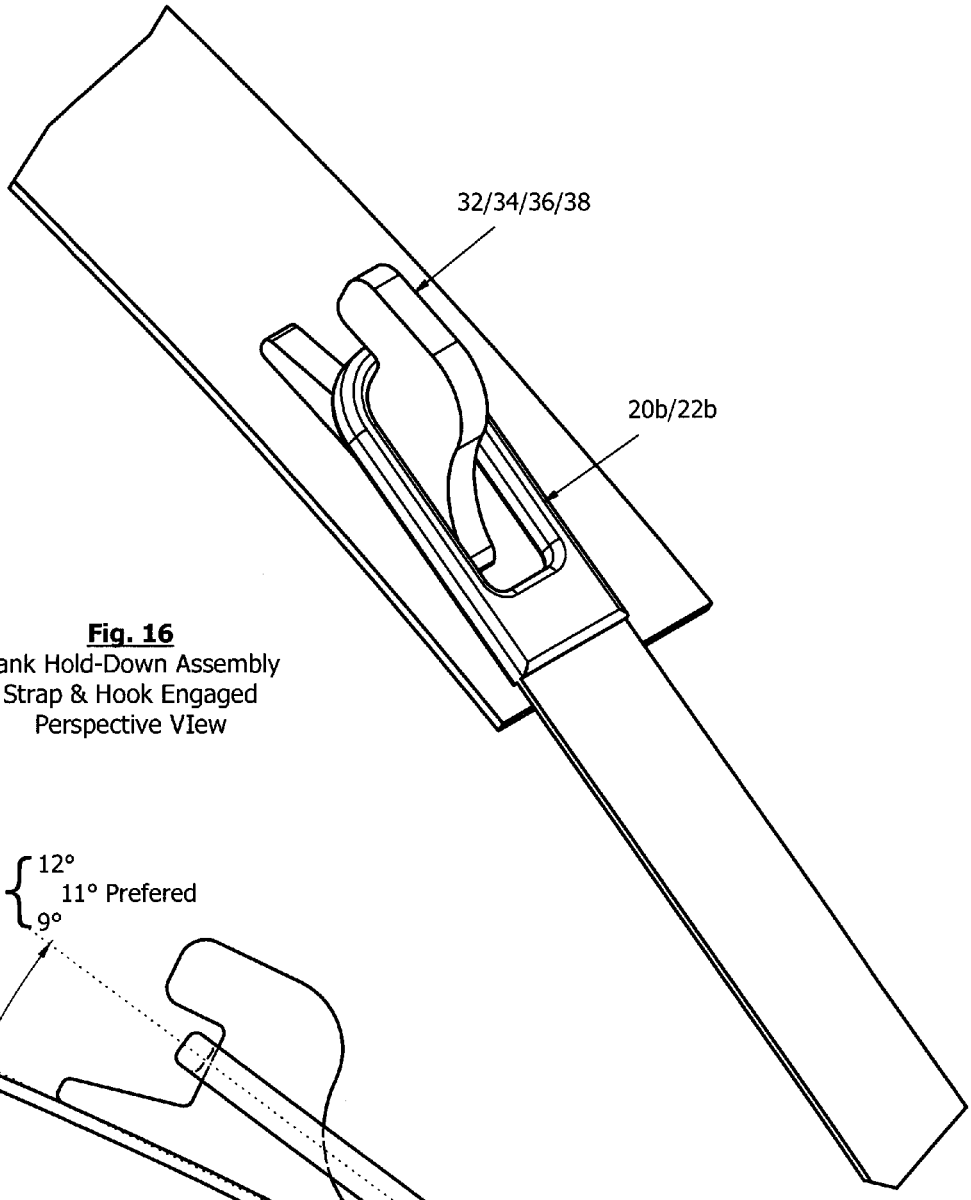
FIG. 16 is a perspective view of tank hold-down assembly 10 with strap and hook together.
Figure 17:
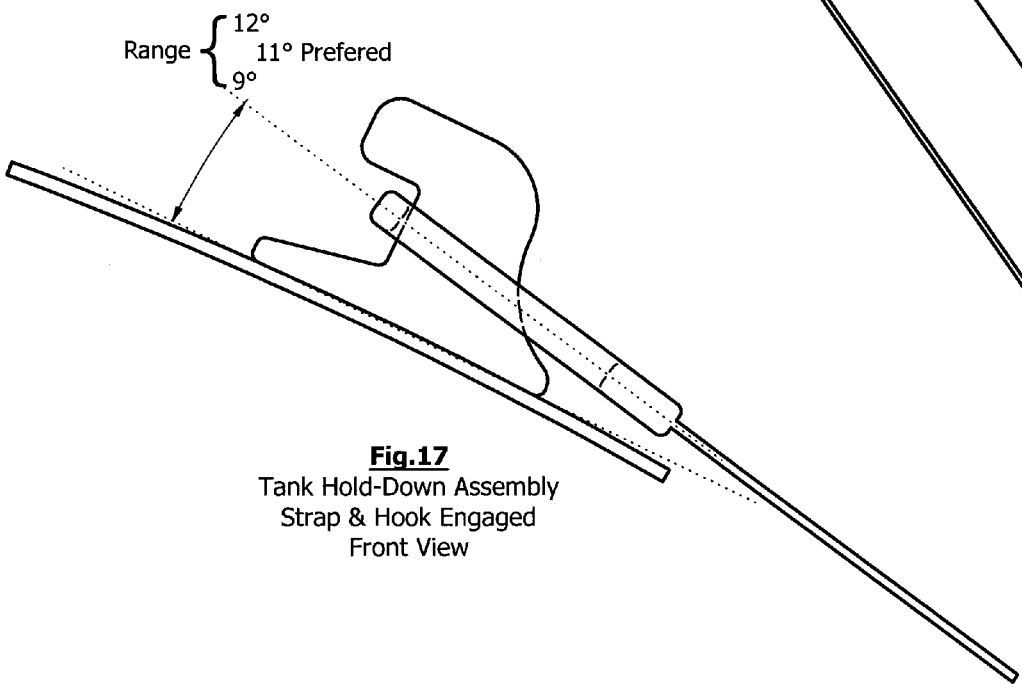
FIG. 17 is a front view of tank hold-down assembly 10 with strap and hook together.

Turning to FIGS. 16 and 17, the manner in which strap end couples to the hook is illustrated. A typical range between the strap end under tension and the base of the hook is about 9° to 12°, with about 11° preferred. Thus, it is seen with respect to FIGS. 9-15 that a specific geometry is provided in a base 32*a*/34*a*/36*a*/38*a*, and mouth 32*b*/34*b*/36*b*/38*b*.

Figure 18:
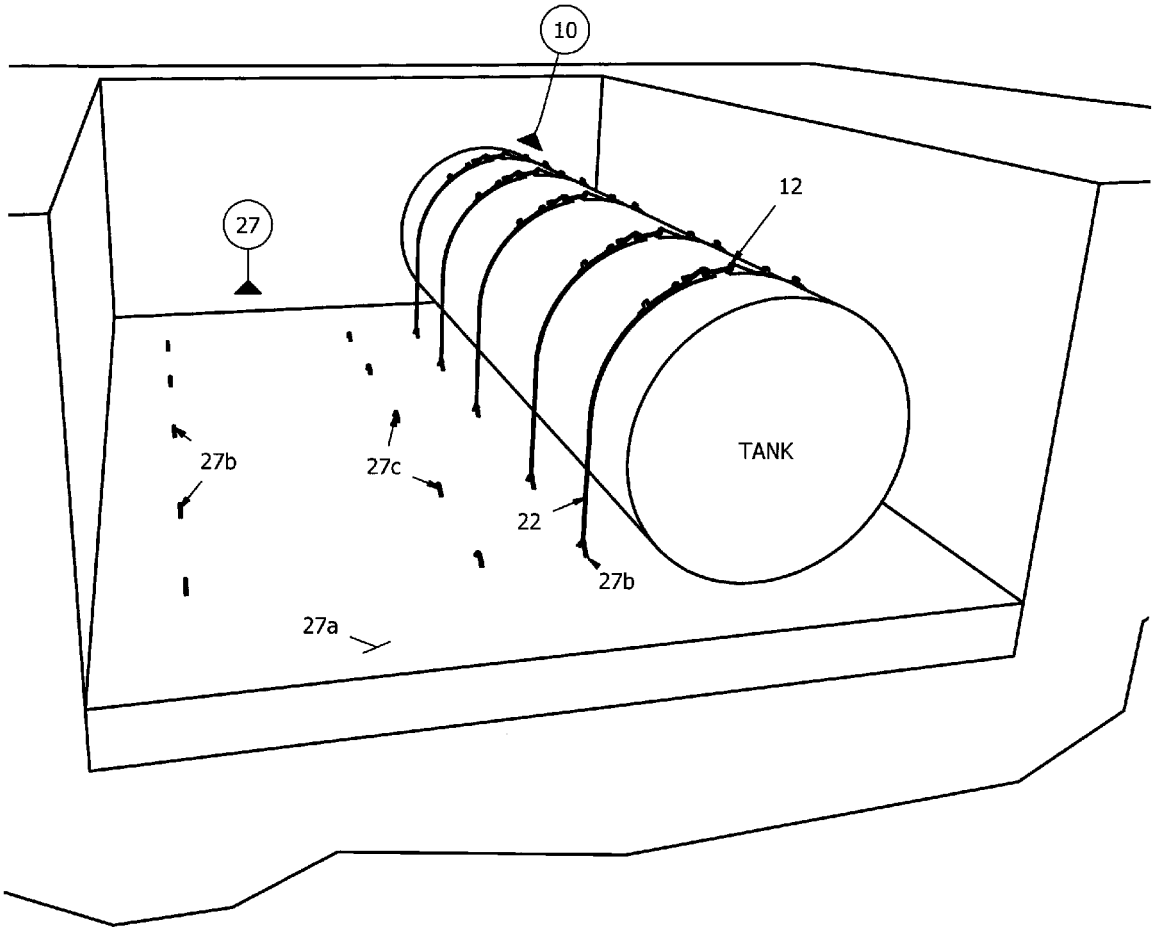
FIG. 18 is a perspective view of tank hold-down assembly 10 with slab option.

FIG. 18 illustrates a view of the tank hold down assembly 10 with an anchor assembly different from what is seen in FIG. 2 (pea gravel). A tank is laid horizontally in an excavated area placed on an integral slab assembly 27, which may be concrete. Slab assembly 27 may have a body 27*a* substantially covering the footprint with upstanding paired loops 27*b*/27*c* on either side of the tank(s) such that the paired straps will meet the body in a generally perpendicular angle. Thus, it is seen with respect to FIG. 18 that the tank may be held down by tank hold-down assembly 10 engaged to a concrete or other suitable integral body. Alternately, pea gravel and separate anchors (each with an upstanding loop) are used as seen in FIG. 2.

FIGS. 15, 16, and 17 illustrate perimeter 21*a*/23*a* and cutouts 21*b*/23*b* of strap second ends 20*a*/22*a*. the perimeters 21*a*/23*a* are dimensioned to fit snugly into the hook mouths at angles illustrated in FIG. 17.

Typical Tank Range

| | Length | | |
|---|---|---|---|
| Diameter | Minimum | Maximum | Strap Length |
| 72" | 6'-0" | 48'-0" | 74" |
| 84" | 7'-0" | 56'-0" | 89" |
| 96" | 8'-0" | 64'-0" | 100" |
| 108" | 9'-0" | 72'-0" | 115" |
| 120" | 10'-0" | 80'-0" | 128" |
| 126" | 10'-6" | 84'-0" | 138" |
| 144" | 12'-0" | 96'-0" | 159" |

Note:
Diameter and lengths may change depending on typical demand of tanks purchased The table above illustrates the ranges of strap lengths (approximate) that may be used with Applicants' assembly, for different tank sizes.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. An underground fluid storage tank hold-down system for holding down an underground cylindrical fluid storage tank in a hole that has been excavated, the underground tank hold-down system comprising:

a multiplicity of paired hold-down straps, each having a first end and a second end, a length, and a width;

a multiplicity of paired deadmen anchors adapted to be placed to either side of the tank when the tank is in the hole, the deadmen anchors each with anchor upstanding loops; and a tank hold-down assembly comprising a take-up coupler assembly having a pair of arched sections, including a first arched section and a second arched section and a threaded engagement assembly, the threaded engagement assembly including a threaded member and a receiving member adapted to receive part of the threaded member;

wherein the paired straps are adapted to engage the arched sections at a first end of the straps and the paired deadmen anchors at a second end of the straps;

wherein the first and second arched sections each have a curved base with an upper and a lower surface and a first and a second end and a body therebetween, comprise a multiplicity of strap engaging hooks extending upward from the upper surface thereof and walls to engage the threaded engagement assembly such that rotation of the threaded member when it is engaged with the receiving member brings the two sections closer to one another and snugs the straps down to the walls of the underground tank;

wherein the multiplicity of hooks on each arched section is two and wherein the hooks on each arched section are both spaced apart so they are each a first and a second distance from the second end of the arched sections, the first distance being more than the second distance and offset to either side of a longitudinal axis of the arched sections, the offset at a minimum at least about equal to half the width of the hold-down straps.

2. The underground fluid storage tank hold-down system of claim 1, wherein the strap engaging hooks are located on the body such that they are below the threaded engagement assembly when the tank hold-down assembly is in place on the underground cylindrical fluid storage tank.

3. The underground fluid storage tank hold-down system of claim 1, wherein the walls to engage the threaded engagement assembly includes walls to engage the threaded member to the first arched section which include a pair of raised shoulders and a transverse plate, the transverse plate with a hole for receiving the threaded member therethrough; and wherein the walls to engage the threaded engagement assembly include walls to engage receiving member to the second arched section includes a pair of raised shoulders, each of the raised shoulders with cutouts dimensioned to receive a threaded receiver having a transverse member.

4. The underground fluid storage tank hold-down system of claim 1, wherein the walls to engage the threaded engagement assembly to the first and second arched sections are adapted to align with and maintain a longitudinal axis of the threaded member generally coincident with longitudinal axes of the two arched sections.

5. The underground fluid storage tank hold-down system of claim 1, wherein each of the hold-down straps includes an anchor loop hook at one of the ends thereof, the anchor loop hooks with mouths configured to receive the loop therein, and wherein the other ends of the straps include closed loops configured to engage any one of the hooks of an arched section.

6. The underground fluid storage tank hold-down system of claim 1, wherein the straps are non-compressible, with a fixed length, and bendable.

7. An underground fluid storage tank hold-down system for holding down an underground cylindrical fluid storage tank in a hole that has been excavated, the underground tank hold-down system comprising:

a multiplicity of paired hold-down straps, each having a first end and a second end, a length, and a width;

a multiplicity of paired deadmen anchors adapted to be placed to either side of the tank when the tank is in the hole, the deadmen anchors each with anchor upstanding loops; and a tank hold-down assembly comprising a take-up coupler assembly having a pair of arched sections, including a first arched section and a second arched section and a threaded engagement assembly, the threaded engagement assembly including a threaded member and a receiving member adapted to receive part of the threaded member;

wherein the paired straps are adapted to engage the arched sections at a first end of the straps and the paired deadmen anchors at a second end of the straps;

wherein the first and second arched sections have a curved base with an upper and a lower surface and a first and a second end and a body therebetween, comprise a multiplicity of strap engaging hooks extending upward from the upper surface thereof and walls to engage the threaded member to the first arched section and the receiving member to the second arched section such that rotation of the threaded member when it is engaged with the receiving member brings the two sections closer to one another and snugs the straps down to the walls of the underground tank;

wherein each of the arched sections includes a curved base having a first end and a second end, and a body therebetween;

wherein the second end includes the walls configured to engage the threaded engagement assembly and wherein the hooks are located on the body such that they are below the threaded engagement assembly when the tank hold-down assembly is in place on the underground cylindrical fluid storage tank; and wherein the multiplicity of hooks on each arched section is two and wherein the hooks are both spaced apart longitudinally and offset to either side of a longitudinal axis of the arched sections, the offset at a minimum at least about equal to a width of the hold-down straps.

8. The underground fluid storage tank hold-down system of claim 7, wherein the walls to engage the threaded member to the first arched section include a pair of raised shoulders and a transverse plate, the transverse plate with a hole for receiving the threaded member therethrough; and wherein the walls to engage the receiving member to the second arched section includes a pair of raised shoulders, each of the raised shoulders with cutouts dimensioned to receive a threaded receiver having a transverse member and wherein the walls to engage the threaded member to the first and second arched sections are adapted to align with and maintain a longitudinal axis of the threaded member generally coincident with longitudinal axes of the two arched sections.

9. The underground fluid storage tank hold-down system of claim 8, wherein each of the hold-down straps includes an anchor loop hook at one of the ends thereof, the anchor loop hooks with mouths configured to receive the loop therein, and wherein the other ends of the straps include closed loops configured to engage any one of the hooks of an arched section; and wherein the straps are non-compressible, with a fixed length, and bendable.

* * * * *